United States Patent [19]

Druash et al.

[11] 4,377,034

[45] Mar. 22, 1983

[54] SAFETY RAZOR KIT

[76] Inventors: Alex F. Druash, P.O. Box 328, Seabrook, Md. 20801; Denis P. Druash, 2104 Rosemont Dr., Columbus, Ga. 31904

[21] Appl. No.: 205,871

[22] Filed: Nov. 10, 1980

[51] Int. Cl.[3] ..... B26B 21/44

[52] U.S. Cl. ..... 30/41; 30/47; 30/51; 30/90

[58] Field of Search ..... 30/41, 41.5, 90, 47, 30/51, 84

[56] References Cited

U.S. PATENT DOCUMENTS

| | | | |
|---|---|---|---|
| 2,790,234 | 4/1957 | Goldstein | 30/41 |
| 3,344,910 | 10/1967 | Logan | 30/90 X |
| 3,349,484 | 10/1967 | Zeles | 30/90 X |
| 3,417,468 | 12/1968 | Miyauchi | 30/41 |
| 3,726,009 | 4/1973 | Hackmyer | 30/41 |
| 4,023,269 | 5/1977 | Lopez, Jr. | 30/41 |
| 4,074,428 | 2/1978 | Roberts | 30/41 |

*Primary Examiner*—Frank T. Yost

[57] ABSTRACT

The present invention comprises a razor head assembly to which is operatively connected a pre-packaged, pressurized unit of shaving cream or gel. The razor head assembly contains a valve mechanism and an opening whereby the contents of the container of cream or gel may be dispensed as required and needed. The assembly further carries a horizontal mounted bracket for holding the cartridge razor when shaving and a vertically mounted bracket for holding the disposable cartridge at a vertical position along side the razor handle when the kit is not in use. A cover is provided for the razor head assembly when the blade is stored on the razor handle.

7 Claims, 12 Drawing Figures

SAFETY RAZOR KIT

FIELD OF THE INVENTION

The present invention is in the field of toilet articles and more particularly in the field relating to razors utilizing the current disposable cartridge blades. The conventional shaving kit comprises a razor handle component which generally is rigid with a general "T" shape. The bar of the T provides the means upon which the razor blade itself can be mounted. Accompanying this is usually a tube or pressurized container or shaving cream or gel. These two components are somewhat cumbersome but when utilized in the home where they are normally stored in a cabinet, present no particular problem carrying or storage.

However, when travelling on business or pleasure or for use in such outdoor activities as hunting, fishing, hiking or backpacking, canoeing and similar activities, there appears to be several reasons for substituting a compact kit for the separate razor handle and head and accompanying supply of shaving cream or gel. A kit which could be carried in a pocket much in the fashion of a pen or pencil or stowed in luggage or outdoor equipment would be highly desirable. Additionally, such units could serve promotional purposes in connection with various activities such as airline flights, short cruise, trips, or promotional items such as conventions and the like.

In the past, kit-like units have been patented. Generally, they employed a handle element which was hollow and was filled with the cream or gel. Then the contents were dispensed either by manual operation of a plunger-like element or by the use of a biased system which could be controllably released within the handle. The razor head may or may not have been detachable or foldable about the handle unit. Nonetheless, there was a need also to carry the necessary razor blades. As far as is currently known, there has not been available a kit which combined a pressurized supply of shaving cream or gel with a razor handle unit which had a provision for storing a shaving blade when not in use and also provided a means for placing the blades on the handles so it could be used in shaving.

SUMMARY OF THE PRESENT INVENTION

The present invention comprises a razor head assembly to which is operatively connected a pre-packaged, pressurized unit of shaving cream or gel. The razor head assembly contains a valve mechanism and an opening whereby the contents of the container of cream or gel may be dispensed as required and needed. The assembly further carries a horizontal mounted backup for holding the cartridge razor when shaving and a vertically mounted bracket for holding the disposable cartridge at a vertical position along side the razor handle when the kit is not in use. A cover is provided for the razor head assembly when the table is stored on the razor handle.

BRIEF DESCRIPTION OF THE DRAWING

The present invention may be seen in several embodiments in the following drawings which are illustratively only of the structure which the present invention might take.

DETAILED DESCRIPTION OF THE INVENTION

Figure 1:
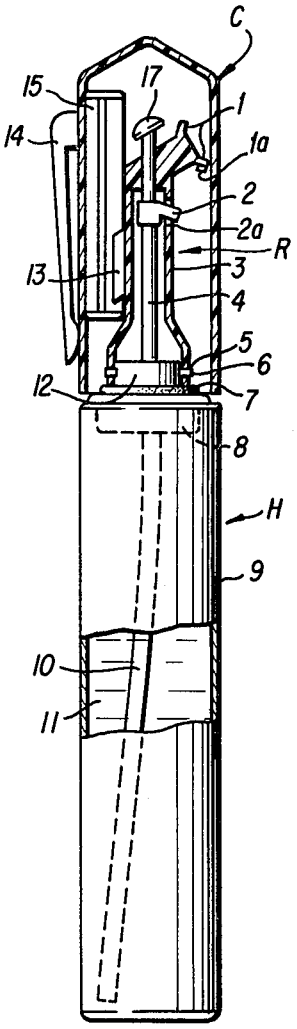
FIG. 1 is a partial sectional view of the present invention in its assembled form for carrying.

Referring now to FIG. 1, it will be seen that the present invention comprises three basic components: A cover assembly C, a razor assembly R and a handle component H.

The razor head assembly R is seen to be comprised of a generally "U" shaped element 1 upon which the razor cartridge 15 is inserted at the time of shaving. The element 1 carries a clip 1*a* which helps retain the cartridge on the bracket member 1. This cartridge holding unit is very similar to that on the conventional T shaped razor handle assembly for disposable cartridge blades and indeed may just be a section of such a unit. The bracket assembly 1 is mounted on a head element 3 which has a channel 18 passing therethrough whose purpose will be described subsequently. Within channel 18 there is disposed at the upper end thereof a dispensing valve plug 2 slidably positioned within channel 18 and functionally moved by means of a vertical plunger 17 so that the contents of the handle component would be dispensed through opening 2*a* in the head element 3.

Figure 2:
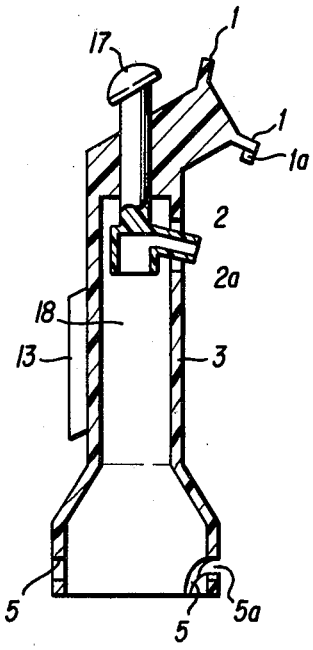
FIG. 2 is a partial cross sectional view of one embodiment of the razor head assembly of the present invention.
Figure 3:
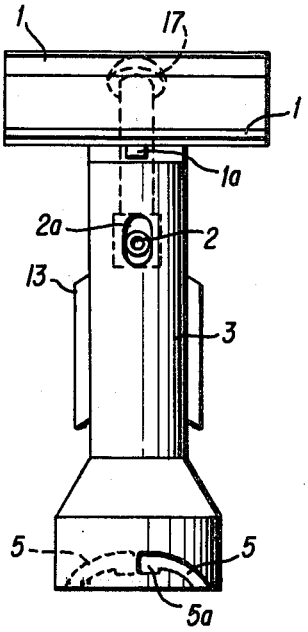
FIG. 3 is an elevation view of the razor head assembly of the present invention as seen in FIG. 2.
Figure 4:
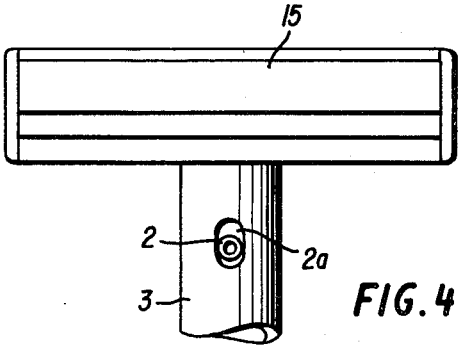
FIG. 4 is an elevation view as seen in FIG. 3 with a disposable razor cartridge installed thereon.

As seen in FIGS. 2 and 3 the base of the head element 3 carries a pair of diametrically opposed upperwardly curving slots 5 which terminate in hook portions 5*a* . Hooks 5*a* receive the ejecting element 6 in FIGS. 1 and 5 which serve to hold the razor head assembly R to the handle component H. The head element 3 carries a bracket 13 on the side opposite the opening 2*a* which bracket serves to hold the razor cartridge when the kit is assembled for carrying.

Figure 5:
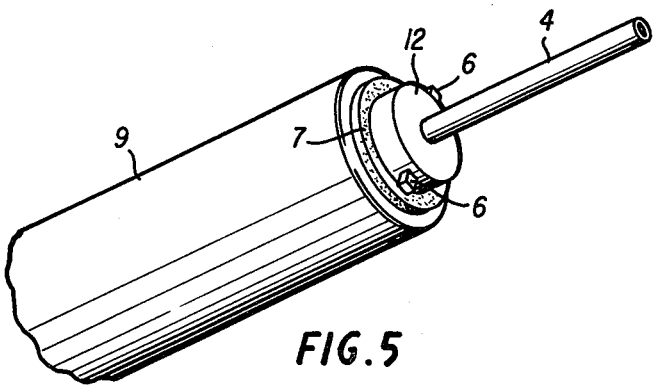
FIG. 5 is a prospective view of the upper portion of the pressurized container which may be employed with the present invention.

The handle assembly H as seen in FIGS. 1 and 5 can be seen to comprise a conventional pressurized dispensing container of shaving cream or gel. The containers are of a size which is commercially available and generally are about ¾ inch in diameter and have an overall length of four inches. The container 9 is provided with a dispenser spout 44 that can be of varying length depending upon the desire of the manufacturer of the present invention. The container 9 is also provided with a resilient ring 7 which may be slid over the top of the spout 4 and also a plastic cap element 12 which contains a projecting element 6. These may be fitted over conventionally available containers 9 or may be placed thereon by the manufacturer of the container 9 with its contents. The purpose of the resilient member 7 is to provide biasing force against the base of the razor head 3 so as to enhance the locking action of the projecting element 6 within the hook portions 5*a* at the base of the razor head 3.

The cover component C of the embodiment shown in FIGS. 1 through 5 is seen to have a slightly conical top which may alternatively be arcuate or flat. Attached to the side of the cap 16 is the clip element 14 which is optional accessory. The disposable razor cartridge 15 maay be of the single or twin blade variety at the option of the user.

In connection with the embodiment shown in FIGS. 1 through 5, it should be pointed out that the projecting element 6 as shown in the drawings could be replaced with partial thread-like or angled flange which would accomplish the same purpose.

Figure 6:
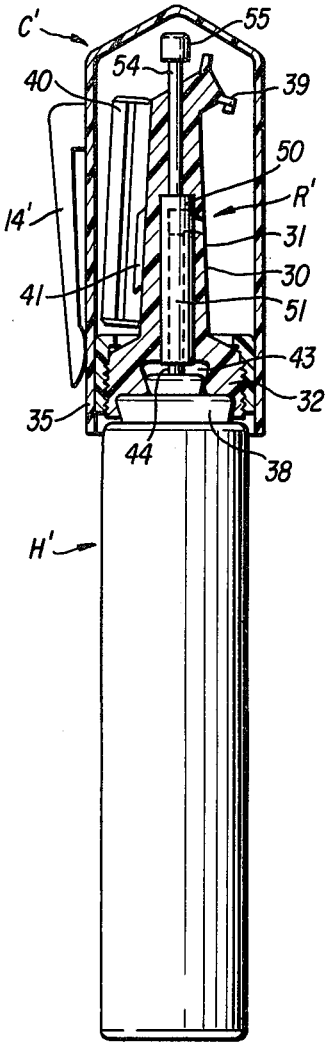
FIG. 6 is an elevation view in partial section of an alternate razor head assembly of the present invention in assembled form for carrying.
Figure 7:
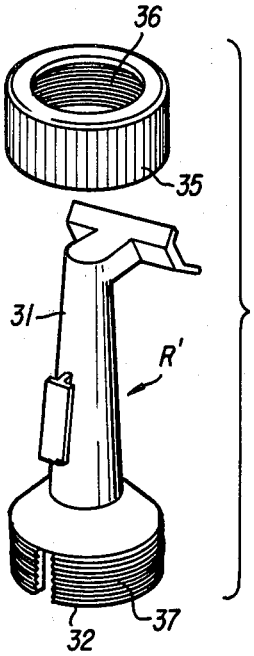
FIG. 7 is an exploded perspective view of the razor head assembly of the embodiment in FIG. 6.
Figure 8:
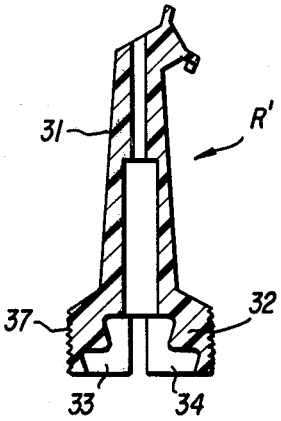
FIG. 8 is a cross sectional view and elevation of the razor head assembly of the embodiment shown in FIG. 6.

Referring now to FIGS. 6 through 9 it will be seen an alternate embodiment of the razor assembly 3 shown in FIGS. 1 through 5. In the alternate embodiment seen in FIGS. 6 through 9 the method of securing the razor head assembly to the handles/container H' is accomplished in a different manner. It will be seen that the lower flange 32 of the razor head 31 is bifurcated thereby providing two generally semicircular clamping members 33 and 34. The outer surface of the flange 32 will be seen to be threaded. Over this razor head assembly 30 is placed a collar 35 having matching threads 36 on the inner surface to cooperate with threads 37 on flange 32. As the collar 35 is turned down over the flange 32 the bifurcated members 31 and 34 are drawn together and thus clamp the upper portion or end 38 of the handle/container H'. While the razor head assembly 30 is shown used with a handle/container H' having a different top configuration than the handle/container H in FIGS. 1–5, it will be appreciated that the principle of the clamping provided by the bifurcated head assembly 30 can be applied with equal results to a handle/container not having a particular confirmation as shown in FIG. 6.

Razor head assembly 30 has a bracket 39 to hold a razor cartridge in a shaving position. As seen in FIG. 6 the razor cartridge 40 is attached to a bracket 41 which is secured to the outer surface of the razor head 31.

Figure 9:
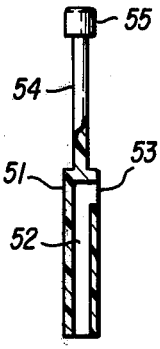
FIG. 9 is a cross sectional view of the valve assembly of the embodiment shown in FIG. 6.

For dispensing the contents of the handle/container H', the razor head 30 is provided with a valve assembly 50 as seen in FIGS. 6 and 9. The valve assembly 50 comprises a valve element 51 having a axial passageway 52 which terminates in an outlet 53. The valve 51 is actuated by level 54 to which may be attached by frictional or screw means a handle or cap 55. In operation the plunger 54 is depressed through a passageway 42 in the upper portion of the razor head 30. This in turn depresses the valve 51 which acts upon the outlet 44 of the handle/container H' as the valve 51 moves down through passageway 43 in the razor head 31. This action releases the contents of the handle/container H' as long as plunger 54 is depressed and allows the contents to flow upward through channel 52 and valve 51 into the outlet 53. Since the outlet 44 of the handle/container H' is spring biased within the handle/container, release of pressure on the plunger 54 will automatically move the valve assembly 50 upwardly and thus cut off the flow of the contents of the handle/container H'.

Figure 10:
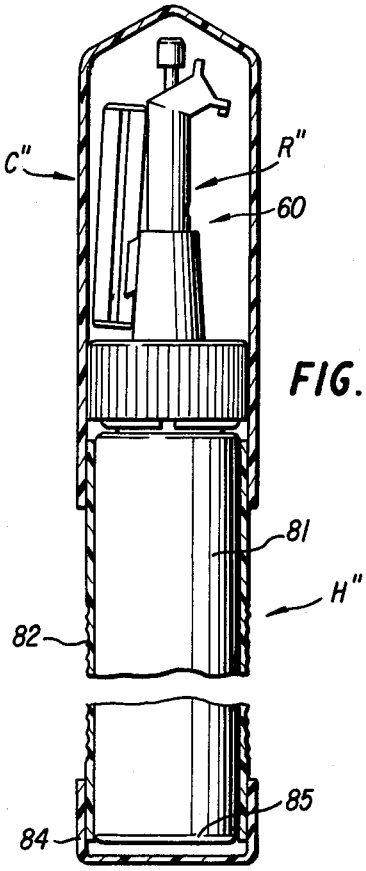
FIG. 10 is an elevation view in partial section of the third embodiment of the kit of the present invention.

Referring now to FIG. 10, there is disclosed an alternate embodiment of the razor head assembly 30 seen in FIG. 6. The razor head assembly 60 seen in FIG. 10 comprises two principal portions. There is a base portion 61 which has a bifurcated flange 62 similar to the bifurcated flange 32 of razor head assembly 30. Within the base portion there is placed a razor head portion 63 which is slidably fitted within passageway 64 of base 61. A razor head 63 contains an axial passageway 64 in its base which connects with an outlet 65. In this embodiment the contents of the handle/container are released by depressing the razor head 63 downwardly in passageway 64. When the handle discharge bottom 66 of the razor head 63 contacts the discharge nozzle of a handle/container, and pressing it downwardly, causes the contents to flow upward through passageway 64 and outlet 65. Release of downward pressure on the razor head 63 will allow the razor head 63 to be pushed upwardly by the biasing element in the handle/container. The razor head assembly 60 is provided with the previously described bracket 67 for holding the razor cartridge in a shaving position and a bracket 68 for holding the razor cartridge in a storage position.

Figure 11:
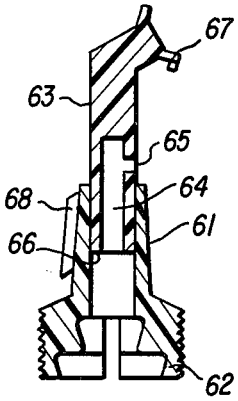
FIG. 11 is a cross sectional view in elevation of an alternative embodiment of a razor head.
Figure 12:
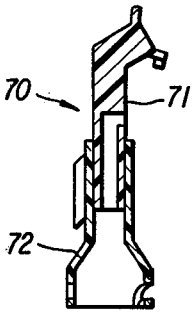
FIG. 12 is a cross sectional view in elevation of an additional alternative embodiment of a razor head.

Referring now to FIG. 12, it will be seen that the razor head assembly 70 as shown therein to be said to be a combination of a portion of the razor head assembly R of FIGS. 1 and 2 and razor head assembly shown in FIG. 11. Razor head assembly 70 comprises a base portion 72 which is substantially identical to the base of the assembly R shown in FIGS. 1 and 2 with a razor head 71 which is essentially identical to razor head 63 in razor head assembly 60 as seen in FIG. 11.

Referring now to FIG. 10, there will be seen a modification of the present invention in that the cover consists of a cap portion C" within which there is a razor portion R" and a handle portion H" which is integrally formed with the razor head assembly portion R" to form a casing into which a container 81 can be inserted. The casing 82 is provided with a cap 84 to close the lower open end 85 of the casing 82. The cap is secured over the lower edge at the lower end 85 of the casing 82 by frictional fit, threaded means, locking lugs or other similar well known means of providing temporary and removable closures for the open end of the casing. If desired, at least a portion of the outer surface 86 of the casing 82 may be provided with a roughened surface to enhance the handling of the unit, thus decreasing the possibility of the handles slipping within the grip of the holder.

While the present invention has been illustrated in several embodiments, the invention has an entity and components thereof, it will be recognized by those with skill in the art that other modifications in the designs or confirmation of various elements are possible and that such would fall within the scope of the invention as set forth in the following claims.

What is claimed is:

1. A safety razor kit comprising a razor head assembly and a handle component of at least a disposable, pre-packaged, pressurized unit of shaving cream or gel operatively connected to said razor head assembly for dispersement of it contents through said assembly and a valve mechanism and associated opening in said assembly for said dispersement; said assembly comprising an elongated head element having a first element mounted perpendicularly thereto on one end to hold a disposable razor cartridge for shaving, a bracket on the lower portion of said element and mounted parallel to the long axis of said head element to store said cartridge, a flared base element on the other end of said head element to engage said handle component, and a passageway extending inwardly from said base element into said head element to receive a spring-biased dispenser spout from said handle component which is selectively contacted by said valve mechanism which is slidably positioned in said passageway.

2. The kit according to claim 1 wherein said valve mechanism comprises a valve plug having a nozzle extending through said associated opening and a plunger attached to the upper surface of said plug and extending through said head element for depression by a shaver into contact with said spout for said dispersement.

3. The kit according to claim 1 wherein said head element and said base element are separate elements, said head element being slidable within the passageway in said base element to activate said dispensing nozzle as said valve mechanism.

4. The kit according to claim 1 wherein there are means on said head assembly which cooperate with said handle component to secure said assembly to said handle component.

5. The kit according to claim 4 wherein said head assembly has a flared base element and said means comprise a pair of diametrally positioned upwardly curving slots in said base element which frictionally engage projecting elements on the top of said handle component.

6. The kit according to claim 4 wherein said base element is bifurcated and said means comprise threads on the outer surface of said bifurcated portions which cooperate with threads on the inner surface of a rotatable collar placed on said base element and having an interior diameter such that the threading of the collar on the base element frictionally grips the upper end portion of the handle component within the bifurcated portions.

7. The kit according to claim 1 further comprising a cap assembly for said head assembly when said kit is not in use.

* * * * *